United States Patent [19]

Riemscheid et al.

[11] Patent Number: 4,841,679

[45] Date of Patent: Jun. 27, 1989

[54] METHOD AND APPARATUS FOR MANUFACTURING CAM ELEMENTS

[75] Inventors: Helmut Riemscheid, Lohmar; Engelbert Schwarz, Winterscheid, both of Fed. Rep. of Germany

[73] Assignee: Emitec Gesellschaft für Emissionstechnologie mbH, Fed. Rep. of Germany

[21] Appl. No.: 83,653

[22] Filed: Aug. 7, 1987

[30] Foreign Application Priority Data

Aug. 7, 1986 [DE] Fed. Rep. of Germany ..... 3626683

[51] Int. Cl.[4] ..... B24B 19/12

[52] U.S. Cl. ..... 51/281.C; 51/34.6; 51/40; 51/51; 51/98.5; 51/92 ND

[58] Field of Search ..... 51/34 C, 34 H, 37, 38, 51/40, 42, 51, 74 R, 80 A, 81 R, 84 R, 88, 89, 95 R, 95 WH, 98.5, 101 R, 105 EC, 106 R, 281 C, 92 R, 92 ND

[56] References Cited

U.S. PATENT DOCUMENTS

| | | | |
|---|---|---|---|
| 772,785 | 10/1904 | Clarke | 51/101 R |
| 871,522 | 11/1907 | Peirce | 51/42 X |
| 1,696,660 | 12/1928 | Wegner | 51/95 WH X |
| 1,945,471 | 1/1934 | Walls | 51/38 X |
| 2,848,848 | 8/1958 | Hutchins | 51/101 R |

FOREIGN PATENT DOCUMENTS

| | | | |
|---|---|---|---|
| 590713 | 8/1977 | Switzerland | 51/74 R |

*Primary Examiner*—Robert P. Olszewski
*Attorney, Agent, or Firm*—Toren, McGeady & Associates

[57] ABSTRACT

Cam elements (1), which are to be secured to a shaft to make a built-up cam shaft assembly, have their peripheries ground to the required shape by being supported in alignment with one another and ground by at least one pass of a contoured grinding wheel or wheels along the held cam elements in a direction parallel to the axis thereof.

17 Claims, 1 Drawing Sheet

METHOD AND APPARATUS FOR MANUFACTURING CAM ELEMENTS

BACKGROUND TO THE INVENTION

Field of the Invention

This invention relates to a method, and apparatus, for carrying out an operation in the manufacture of cam elements which are to be fitted to a cam shaft. More particularly, the operation is a grinding operation, and the cam elements each have an aperture extending therethrough for receiving the cam shaft.

Such cam elements are used in manufacture of built-up camshaft assemblies by sliding the cam elements, which are finished to the required cam profile, onto a tubular or profiled cam shaft and fixing the cam elements in the required relative position thereon. The cam elements may be fixed by interfitting with the shape of the shaft, or by deforming the shaft so that the cam elements are held thereon. The object of thus building up a complete camshaft assembly is to reduce weight and rationalise production. The cam elements, although previously substantially finished to the required cam profile, may be finish ground after they have been secured to the shaft in the same way as are the cams of camshafts which are made in one piece, by suitable grinding wheels automatically controlled to move relative to the assembled camshaft while the camshaft is rotating.

SUMMARY OF THE INVENTION

It is the object of the present invention to provide an improved process for grinding cam elements to the required shape, with a high degree of accuracy and which can be carried out at high speed and low cost.

According to a first aspect of the invention, we provide a method of grinding cam elements, each having an aperture extending along a cam shaft axis therethrough for receiving a cam shaft (for rotation about the cam shaft axis in use) the method comprising holding a plurality of the cam elements together in alignment with one another, and grinding the peripheral surface of all the cams together by at least one contoured grinding wheel rotating about an axis perpendicular to and spaced from the cam shaft axis and moved relative to the held-together cam elements in a direction parallel to the cam shaft axis.

In the method according to the invention, part of the required shape of the cam elements is determined by the contour of a suitable grinding wheel which moves past the cam elements parallel to the cam shaft axis. When a plurality of cam elements are held together in alignment with one another, which cam elements preferably provide all the cam elements needed to make a particular camshaft, a set of cam elements identical to one another is produced, irrespective of any wear which may occur in the or each grinding wheel used in the process.

The method according to the invention may use one contoured grinding wheel, or two or more different ones, with the number of such grinding wheels leading to different methods by which the held-together cam elements must be moved relative to the grinding wheel or wheels.

In one method, a first grinding operation may be carried out by relative movement of a grinding wheel in a first pass parallel to the cam shaft axis, followed by rotation of the held-together cam elements through 180° about an axis perpendicular to the cam shaft axis and parallel to the rotational axis of the grinding wheel and then a second pass of a grinding wheel parallel to the cam shaft axis, preferably in the opposite direction to that of the first pass. Thus half the circumference of each of the cam elements is ground in each pass of the grinding wheel, so the contour of the grinding wheel must correspond to half the peripheral shape of a cam element which is of symmetrical form. After the first pass of the grinding wheel, the held-together cam elements may alternatively be turned through 180° about an axis perpendicular to both the cam shaft axis and the axis of the grinding wheel, and through 180° about the cam shaft axis, to bring them to the required position for the second pass of the grinding wheel.

In an alternative method, a first grinding operation may be carried out on the held-together cams by a pass of a first grinding wheel parallel to the cam shaft axis, after which the cam elements are turned through 180° about the cam shaft axis and subjected to a second grinding pass, preferably in the opposite direction parallel to the cam shaft axis, of a second contoured grinding wheel. Such second contoured grinding wheel may be positioned on the same shaft as the first grinding wheel, movable relative to the held-together cam elements along the axis of such shaft. Such a method may be used for producing cam elements which are asymmetrical, i.e. their peripheral profiles in respect of cam rise and fall are different from one another.

In a third method according to the invention, a number of contoured grinding wheels may be arranged for rotation about different axes spaced about the cam shaft axis of the held-together cam elements and spaced from one another along the cam shaft axis. In such an arrangement, the contours of the grinding wheels correspond to different peripheral regions of the cam elements, and if there are two grinding wheels each may have a contour to provide half of the circumference of the cam elements. In such a method, the held-together cam elements are moved relative to the wheels, along the cam shaft axis between the grinding wheels in a single pass, and in the case of an individual cam element the grinding of the different parts of the periphery thereof follow one another chronologically.

Preferably each of the grinding passes is carried out by movement of the grinding wheel or wheels with the cam elements held stationary.

A method according to the invention makes it possible to produce cam profiles which have small radii, and especially small inner radii which cannot be achieved by the large grinding wheels used for conventional cam grinding. Further, the method according to the invention leaves microscopic grooves on the surface of the cam elements which extend transversely to the direction in which rubbing of the cam followers occurs at the cam element surface in use, which is advantageous for establishment and maintenance of a lubricating oil film.

The invention also provides apparatus for carrying out the method according to the invention, and in such apparatus the embodiments differ from one another in the arrangement of contoured grinding wheels relative to a device for holding the plurality of cam elements together in the aligned state. An essential feature of this further aspect of the invention is a holding device for holding the plurality of cam elements together in alignment with one another, which device may comprise a clamping mandrel which is itself held by a device permitting the mandrel to be turned through 180° about the cam shaft axis or an axis perpendicular to the cam shaft axis, as well as for rotation of the mandrel through 180° about its longitudinal axis.

If there are more than two grinding wheels disposed circumferentially about the mandrel axis, it is advantageous if there is some overlap in respect of the portions of the periphery of the cam elements which they are arranged to grind.

DESCRIPTION OF DRAWINGS

The invention will now be described by way of example with reference to the accompanying drawings, of which.

DESCRIPTION OF PREFERRED EMBODIMENTS

Figure 1:
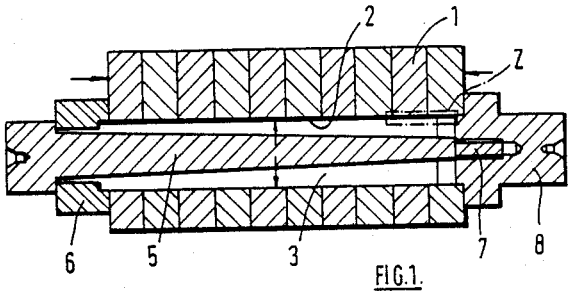
FIG. 1 shows an assembly of a plurality of cam elements, held together by a clamping device.
Figure 1A:
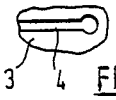
FIG. 1*a* shows a detail of the part Z of FIG. 1.

Referring firstly to FIG. 1, there is shown, in longitudinal section, a clamping device which holds together ten individual cam elements 1 with respective apertures 2 in alignment with one another. The peripheries of the cam elements are also in alignment with one another. The clamping device comprises a sleeve 3 having an outside diameter which is substantially equal to the diameter of each of the apertures 2 extending through the cam elements, the sleeve being split by an axially extending slot indicated at 4 in FIG. 1 *a*, which is a detail Z note FIG. 1. The sleeve 3 has a conically tapering internal surface, within which fits a correspondingly conically tapering expander member 5. One end of the expander member 5 abuts a supporting annulus 6 which in turn abuts the assembly of cam elements 1, whilst the other end of the expander 5 has a screw-threaded end portion 7 which engages a nut 8 which in turn abuts the other end of the plurality of cam elements 1. The abutment annulus 6 may incorporate a spring arrangement. It will be appreciated that by tightening the nut 8 onto the expander 5, the assembly of cam elements is clamped axially as well as being firmly held by expansion of the sleeve 3 within the apertures 2 extending through the cam elements.

In practice, the axis of the mandrel assembly comprising sleeve 3, expander 5 and their associated parts will usually be the axis of rotation of a finished shaft assembly when the cam elements are eventually mounted on and secured to a separate shaft element. Even if in some constructions the axis of the sleeve and expander is not actually the rotational axis of the finished shaft, the common axis of the apertures through the cam elements is herein referred to as the cam shaft axis, and is indicated as axis A in FIGS. 2 and 3. Apparatus for carrying out the method of the invention will include means for holding the clamping device for the cam elements, and for effecting the various rotations thereof which are described hereafter.

Figure 2:
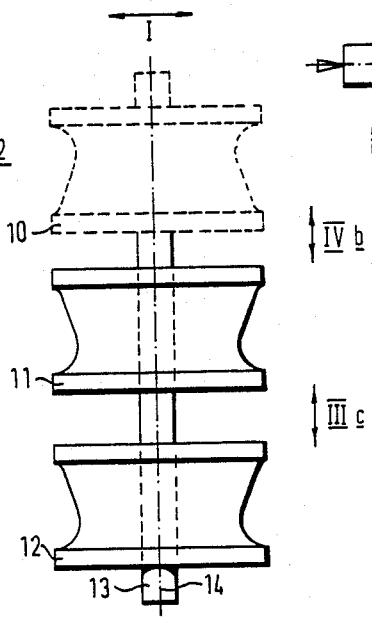
FIG. 2 shows, diagrammatically, the disposition of such an assembly of cam elements relative to a first arrangement of grinding wheels.

Referring now to FIG. 2 of the drawings, this shows the held-together assembly of cam elements 1 relative to some grinding wheels. The grinding wheels 10, 11, 12 are provided on a shaft 13 rotatable about an axis 14, and the grinding wheels have a profile which corresponds to portions, as described hereafter, of the peripheral profile required on the cam elements. The cam shaft axis A extends perpendicularly to the rotational axis 14 of the grinding wheels, and spaced therefrom. In the method of the invention, grinding of the circumferential surface of the cam elements is effected in a number of passes of one or more grinding wheels along the held-together assembly of cam elements in directions parallel to the cam shaft axis A, which movements are indicated by the double arrow I.

If the first grinding operation comprises a pass of the grinding wheel 11 along the assembly of cam elements parallel to the axis A, this will shape half the periphery of each cam element. Thereafter, the assembly of cam elements must be turned through 180° about axis B which lies in the plane of the drawing, being perpendicular to the cam shaft axis A and parallel to the grinding wheel axis 14. Such movement of the assembly of cam elements is indicated by the arrow II, and presents the opposite side of the assembly of cam elements to the grinding wheel. Grinding of the periphery of such opposite sides of the cam elements may then be effected by another pass of the grinding wheel along the assembly of cam elements, preferably in the opposite direction to that of the first pass. The same grinding wheel 11 or another grinding wheel 12 may be used for such second pass, and in the latter case the grinding wheel must be moved along their rotational axis 14, as indicated by arrow IIIc, to bring the other grinding wheel into the correct position relative to the assembly of cam element. If the required shape of the cam elements is symmetrical, the same grinding wheel can be used for both passes, whereas if the shape is asymmetrical then differently contoured grinding wheels 11, 12 must be used.

Instead of turning the assembly of cam elements about axis B, it may be turned through 180° about an axis C perpendicular to the plane of the drawing, as indicated by arrow IIIb. In addition to such rotation, it is necessary, previously or subsequently, to turn the assembly of cam elements through 180° about the cam shaft axis A, as indicated by arrow IIIa. In this case too, the same grinding wheel 11 or 12 may be used for both grinding passes, or different wheels in which case movement as arrow IIIc is required to bring the required wheel to its operative position.

If grinding wheels 10, 11, whose contours are generally mirror images of one another, are used in successive grinding passes, a turning through 180° of the assembly of cam elements is required only about the axis A, as indicated by arrow IVa. In this case, movement of the grinding wheels along axis 14, as indicated by arrow IVb, is required to bring the grinding wheels into the required operative positions relative to the assembly of cam elements.

Figure 3:
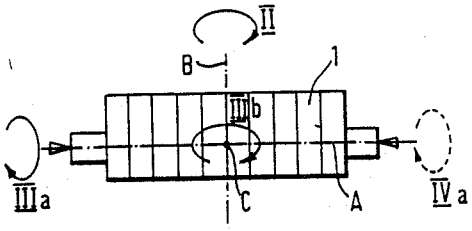
FIG. 3 shows, diagrammatically, an assembly of cam elements relative to a second arrangement of grinding wheels.
Figure 3:
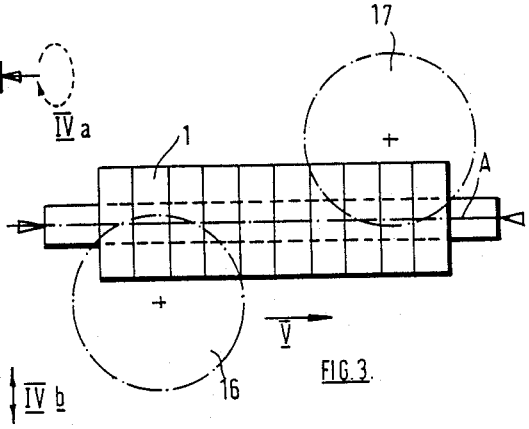

Referring now to FIG. 3, there is shown an assembly of held-together cam elements 1, which is mounted so as to be able to move along the cam shaft axis A as indicated by arrow V. Two grinding wheels 16, 17 are disposed for rotation about respective axes spaced from the axis A on opposite sides thereof and axially separated from one another. Each grinding wheel has a contour to produce half the required peripheral profile of the cam elements. Only a single pass of the assembly of cam elements is necessary to produce the entire peripheral profile, and it will be appreciated that in such a pass the grinding of one half of the profile of each cam element takes place subsequently to the grinding of the other half. It would be possible for more than two grinding wheels to be spaced about the axis along which the assembly of cam elements is moved, and there may be some overlap between the parts of the cam element peripheries which are shaped by such grinding wheels.

We claim:

1. A method of grinding cam elements, each having an aperture extending along a cam shaft axis therethrough for receiving a cam shaft, the method comprising holding a plurality of the cam elements together in alignment with one another and grinding the peripheral surface of all the cam elements together by at least one contoured grinding wheel rotating about an axis perpendicular to and spaced from the cam shaft axis and moving one of the held-together cam elements and the grinding wheel relative to the other in a direction parallel to the cam shaft axis.

2. A method of grinding cam elements, each having an aperture extending along a cam shaft axis therethrough for receiving a cam shaft, the method comprising holding a plurality of the cam elements together in alignment with one another and grinding the peripheral surface of all the cams together by at least one contoured grinding wheel rotating about an axis perpendicular to and spaced from the cam shaft axis, and moved relative to the held-together cam elements in a direction parallel to the cam shaft axis and moving relative to the held together cam elements in a direction parallel to the cam shaft axis, carrying out a first grinding operation by movement of a grinding wheel in a first pass parallel to the cam shaft axis, then rotating the held-together cam elements through 180° about an axis perpendicular the cam shaft and parallel to the rotational axis of the grinding wheel and then carrying out a second pass of a grinding wheel parallel to the cam shaft axis.

3. A method of grinding cam elements, each having an aperture extending along a cam shaft axis therethrough for receiving a cam shaft, the method comprising holding a plurality of the cam elements together in alignment with one another, and grinding the peripheral surface of all the cam elements together by at least one contoured grinding wheel rotating about an axis perpendicular to and spaced from the cam shaft axis, and moved relative to the held-together cam elements in a direction parallel to the cam shaft axis, carrying out a first grinding operation by movement of a grinding wheel in a first pass parallel to the cam shaft axis, then rotating the held-together cam elements through 180° about an axis perpendicular to both the cam shaft axis and the axis of rotation of the grinding wheel, and through 180° about the cam shaft axis, and then carrying out a second pass of a grinding wheel parallel to the cam shaft axis.

4. A method according to claim 2 wherein said first and second grinding wheel passes are carried out in opposite directions to one another, parallel to the cam shaft axis.

5. A method according to claim 2 wherein said second grinding wheel pass is carried out by the same grinding wheel as the first pass.

6. A method according to claim 2 wherein said second grinding wheel pass is carried out by a second grinding wheel brought into a required position relative to the held-together cam elements.

7. A method according to claim 3 wherein said first and second grinding wheel passes are carried out in opposite directions to one another, parallel to the cam shaft axis.

8. A method according to claim 3 wherein said second grinding wheel pass is carried out by the same grinding wheel as the first pass.

9. A method according to claim 3 wherein said second grinding wheel pass is carried out by a second grinding wheel brought into a required position relative to the held-together cam elements.

10. A method for grinding cam elements, each having an aperture extending along a cam shaft axis therethrough for receiving a cam shaft, the method comprising holding a plurality of the cam elements together in alignment with one another and grinding the peripheral surface of all the cams together by at least one contoured grinding wheel rotating about an axis perpendicular to and spaced from the cam shaft axis, and moved relative of the held-together cam elements in a direction parallel to the cam shaft axis and moving relative to the held-together cam elements in a direction parallel to the cam shaft axis, carrying out a first grinding operation by a pass of a first grinding wheel parallel to the cam shaft axis, then rotating the held-together cam elements through 180° about the cam shaft axis, and then carrying out a pass of a second grinding wheel in a direction parallel to the cam shaft axis.

11. A method according to claim 1 wherein a number of contoured grinding wheels are disposed for rotation about different axes spaced about the cam shaft axis and further spaced from one another in a direction parallel to the cam shaft axis, and grinding of the periphery of the cam elements is carried out by a pass of the held-together cam elements relative to the grinding wheels, along the cam shaft axis between such grinding wheels.

12. A method according to claim 1 wherein each of said grinding passes is carried out by movement of the grinding wheel or wheels with the cam elements held stationary.

13. Apparatus for grinding cam elements each having an aperture extending along a cam shaft axis therethrough to receive a cam shaft, comprising means for holding a plurality of the cam elements together in alignment with one another, and means supporting at least one contoured grinding wheel for rotation about an axis perpendicular to and spaced from the cam shaft axis and for movement relative to the held-together cam elements in a direction parallel to the cam shaft axis, said means for holding the cam elements is rotatable through 180° about an axis perpendicular to the cam shaft axis and parallel to the axis of rotation of the grinding wheel.

14. Apparatus for grinding cam elements, each having an aperture extending along a cam shaft axis therethrough for receiving a cam shaft, the method comprising holding a plurality of the cam elements together in alignment with one another and grinding the peripheral surface of all the cams together by at least one contoured grinding wheel rotating about an axis perpendicular to and spaced from the cam shaft axis, and moving one of the held-together cam elements and the grinding wheel relative to the other in a direction parallel to the cam shaft axis and moving relative to the held-together cam elements in a direction parallel to the cam shaft axis, said means for holding the cam elements is rotatable through 180° about an axis perpendicular to both the cam shaft axis and the axis of rotation of the grinding wheel.

15. Apparatus according to any one of claims 13 or 14 wherein said means for holding the cam elements is rotatable through 180° about the cam shaft axis.

16. Apparatus according to any one of claims 13 or 14 comprising two contoured grinding wheels, supported on a common shaft and axially movable thereon to bring them to required positions relative to the held-together cam element.

17. Apparatus according to claim 13 or 14 comprising a plurality of contoured grinding wheels disposed about respective rotational axes spaced from the cam shaft axis and also spaced from one another in a direction parallel to the cam shaft axis.

* * * * *